US006561268B2

(12) United States Patent
Jones

(10) Patent No.: US 6,561,268 B2
(45) Date of Patent: May 13, 2003

(54) CONNECTOR

(75) Inventor: Mark R. Jones, Grange-Over-Sands (GB)

(73) Assignee: Tronic Limited, Cumbria (GB)

( * ) Notice: Subject to any disclaimer, the term of this patent is extended or adjusted under 35 U.S.C. 154(b) by 0 days.

(21) Appl. No.: 09/899,677

(22) Filed: Jul. 5, 2001

(65) Prior Publication Data

US 2002/0014336 A1 Feb. 7, 2002

(30) Foreign Application Priority Data

Jul. 5, 2000 (GB) ..... 0016572

(51) Int. Cl.[7] ..... E21B 29/02; E21B 43/00; E21B 29/12

(52) U.S. Cl. ..... 166/65.1; 166/338; 439/191; 439/140; 439/201

(58) Field of Search ..... 166/65.1, 338, 166/368, 341; 439/191, 194, 195, 140, 201

(56) References Cited

U.S. PATENT DOCUMENTS

| | | | | | |
|---|---|---|---|---|---|
| 2,178,931 | A | * | 11/1939 | Crites et al. | 174/47 |
| 2,531,120 | A | * | 11/1950 | Feaster | 173/79 |
| 2,827,506 | A | * | 3/1958 | Nicholas | 174/21 R |
| 3,518,609 | A | * | 6/1970 | Fontenot, Jr. | 175/104 |
| 3,696,332 | A | * | 10/1972 | Dickson et al. | 174/47 |
| 3,808,577 | A | | 4/1974 | Mathauser | |
| 4,012,092 | A | * | 3/1977 | Godbey | 439/191 |
| 4,589,717 | A | * | 5/1986 | Pottier et al. | 439/140 |
| 4,690,212 | A | * | 9/1987 | Termohlen | 166/65.1 |
| 4,799,544 | A | * | 1/1989 | Curlett | 166/65.1 |
| 4,953,636 | A | * | 9/1990 | Mohn | 166/242.1 |
| 5,052,941 | A | * | 10/1991 | Hernandez-Marti et al. | 166/65.1 |
| 5,209,673 | A | * | 5/1993 | Mohn et al. | 166/65.1 |
| 5,334,801 | A | * | 8/1994 | Mohn | 166/65.1 |
| 5,392,851 | A | * | 2/1995 | Arend | 166/325 |
| 5,967,816 | A | * | 10/1999 | Sampa et al. | 439/190 |
| 5,993,253 | A | * | 11/1999 | Sai | 439/578 |
| 6,161,618 | A | * | 12/2000 | Parks et al. | 137/236.1 |
| 6,392,317 | B1 | * | 5/2002 | Hall et al. | 174/47 |

FOREIGN PATENT DOCUMENTS

| | | |
|---|---|---|
| EP | 0 860 907 A2 | 2/1998 |
| GB | 1 498 612 | 9/1976 |
| GB | 2 282 715 A | 4/1995 |
| GB | 2 318 926 A | 5/1998 |

* cited by examiner

*Primary Examiner*—Robert E. Pezzuto
*Assistant Examiner*—Thomas A. Beach
(74) *Attorney, Agent, or Firm*—Alix, Yale & Ristas, LLP

(57) ABSTRACT

An underwater or severe environment electrical connector, in which first and second connector parts are brought together in longitudinal alignment to establish electrical contact between respective contact portions of the first and second connector parts. The connector parts are relatively rotatable about a longitudinal axis when the connector parts are disconnected, and the contact portions are laterally spaced from the longitudinal axis and arranged to make electrical contact when the connector parts are connected, irrespective of the relative rotational positions of the first and second connector parts about the longitudinal axis.

20 Claims, 5 Drawing Sheets

CONNECTOR

BACKGROUND OF THE INVENTION

The present invention relates to underwater or severe environment well installations, connectors and electrical connectors.

In the offshore oil and gas industry it is known to provide at the top of a subsea well a so-called subsea tree. This consists of a vertically extending tubing hanger at the base of the tree, and a valve block connected on top of the tubing hanger. In such known systems, the main oil and gas production bore extends up the well and into the central region of the tubing hanger. In a horizontal subsea tree the production line exits the tubing hanger horizontally and in a vertical subsea tree the production line continues vertically through the valve block. It is usual for the connection of the valve block to the tubing hanger to be made when the latter is already installed subsea.

Any electrical or optical supply lines, for example to carry signals or transmit power to downhole equipment such as electrical submersible pumps, are located in the radially outer region of the tubing hanger, in view of the presence of the production line in the central region. Typically, one or more electrical lines are arranged to extend parallel to and spaced from the longitudinal axes of the tubing hanger and valve block respectively. A pin and socket electrical connector in axial alignment with the respective electrical lines is provided to form an electrical connection between the electrical lines when the tubing hanger and valve block are connected together. Thus, one half of the connector is located on the tubing hanger and the other half on the valve block, and both are positioned laterally spaced from the longitudinal axes of the tubing hanger and the valve block. Consequently, the tubing hanger and valve block must be accurately rotationally aligned to ensure that the two halves of the electrical connector can mate to establish an electrical connection. Such rotational alignment can be difficult in view of the substantial size and weight of the valve block and the fact that the connection is being made on the seabed.

SUMMARY OF THE INVENTION

The present invention seeks to overcome this problem by providing, in one aspect, a well installation which can provide an electrical connection without the need for accurate rotational alignment of the parts of the installation.

Viewed from a first aspect, the present invention provides an underwater or severe environment well installation, comprising first and second installation parts having respective longitudinal axes and being connectible with each other with their longitudinal axes in alignment, a first electrical contact portion on the first installation part, and a second electrical contact portion on the second installation part, the contact portions being laterally spaced from the respective longitudinal axes of the installation parts and being arranged to make electrical contact with each other when the first and second installation parts are connected, such electrical contact being achievable at a plurality of different relative rotational positions of the first and second installation parts about their longitudinal axes, and the first and second installation parts further comprising a well production line extending along their aligned longitudinal axes when they are connected with each other.

Thus, rotational alignment of the installation parts to a single predetermined relationship before connection is not required in order to make the electrical contact between the contact portions, even though they are laterally spaced from the longitudinal axis. In some embodiments, only coarse rotational alignment is required, to one of the plurality of available relative rotational positions. In other embodiments, no rotational alignment is required and the electrical contact can be made irrespective of the relative rotational positions of the first and second installation parts about their longitudinal axes. Both types of embodiment are discussed further in this specification.

The lateral spacing of the electrical contact portions from the longitudinal axes of the well installation parts (which may for example comprise a valve block and a tubing hanger of a subsea tree) leaves a central region thereof free for the production line. This is advantageous in the case of a vertical subsea tree, where the production line continues from the tubing hanger vertically through the valve block. Thus, in one specific use of the invention, the first installation part is a valve block and the second installation part is a tubing hanger and an oil or gas production line is provided on the longitudinal axis of the installation.

The first and second installation parts could take various forms, but preferably at least one of the installation parts comprises an annular member for engagement with the other installation part. It is possible for the other installation part to have any suitable configuration for such engagement, and it may therefore not comprise a complete annulus. It is however preferred for both installation parts to comprise "endless" annular members for engagement with each other. Preferably one of the installation parts comprises an axial projection on which a respective electrical contact portion is provided and the other installation part comprises an annular socket in which the axial projection is engageable. The axial projection may be in the form of a pin or the like which may engage in the annular socket at any point around its circumference. Preferably however the axial projection is an annular projection.

In one preferred embodiment, the first and second installation parts are each made up of four or more radial segments consisting alternately of electrical contact segments and insulative material segments. Thus, where four segments are provided, a two way electrical connection will be formed when at least a partial overlap is formed between each electrical contact segment of the first connector part and a respective electrical contact segment of the second connector part. Some coarse rotational alignment will be required to achieve the partial overlap of the contact segments which are to make electrical contact with each other.

Still more preferably however, the respective electrical contact portions will extend about the longitudinal axis to the extent necessary to ensure that electrical contact will be established irrespective of the relative rotational positions of the first and second connector parts. For example, an endless annular contact portion on one connector part can make contact with a contact portion (or portions) on the other connector part of relatively short annular extent. In the embodiment described above, where one of the installation parts comprises an annular projection and the other installation part comprises an annular socket in which the annular projection is engageable, the respective contact portions may be provided continuously or intermittently about the annular projection and annular socket respectively. In a currently preferred embodiment, the electrical contact portion of each connector part comprises a respective annular contact ring. These rings may for example have laterally extending faces arranged to make contact with each other, or longitudinally extending faces arranged to make contact with each other.

A region is preferably provided in the annular socket where, in the connected state of the well installation, the respective contact portions are in electrical contact. Preferably, the annular socket is sealed from the outside environment when the installation is both in the disconnected state and in the connected state. Sealing means for the annular socket is thus provided. This may comprise a resilient e.g. elastomeric seal which is closed when the installation parts are disconnected and is split open or pushed away by the axial, e.g. annular, projection when it is inserted into the annular socket. As a means of closure, this type of seal may be subject to the problem of "compression set", preventing full closure upon disconnection after being deformed to receive the annular projection for an extended period. In a preferred embodiment, therefore, there is provided an annular shuttle resiliently mounted to close the annular socket in the disconnected state of the well installation and arranged to be pushed back into the annular socket by the axial projection when the first and second installation parts are brought together. Thus, the annular shuttle can close and effectively seal the annular socket from the outside environment to keep debris and/or water out of the annular socket when the well installation is disconnected. When the well installation is disconnected, the annular shuttle preferably seals against a pair of resilient seal members radially inwardly and outwardly thereof. When the well installation is connected, the annular projection preferably seals against the pair of resilient seal members.

Where an annular shuttle is used, this could be made of electrically insulative material such that it would have to be pushed back far enough into the annular socket to allow the contact portion on the axial projection to come into contact with the contact portion of the other connector part. However, in this case a relatively complex contact arrangement in the annular socket may be required. Preferably therefore, the annular shuttle comprises electrically conductive material and itself provides the contact portion of the respective installation part. The material will also preferably be suitable for use in a potentially corrosive environment. The annular shuttle may be connected by a flexible lead to a fixed terminal on its respective installation part. Preferably, however, there is provided a contact terminal with which the annular shuttle is not in electrical contact when the installation parts are disconnected, the contact terminal being arranged to be electrically contacted by the annular shuttle when it is pushed back during connection. An electrical connection can thus be made between the contact portion of one connector part and the shuttle, and between the shuttle and the contact terminal of its respective installation part. This arrangement may be useful if the electrical components are "live" prior to connection, as completion of the connection can be arranged to take place only once the live components are within the annular socket.

In one embodiment, the annular socket may be provided with contact terminals on both radial sides thereof. However, the contact terminal preferably comprises at least one contact pin extending longitudinally in the annular socket and arranged to contact the annular shuttle.

In order to facilitate good electrical connection between the annular shuttle and the contact pin, the annular shuttle preferably comprises a recess corresponding in radial cross section to the shape of the contact pin such that the contact pin contacts the side wall of the recess when the shuttle is pushed onto the contact pin. As well as providing good electrical connection, the contact pin arrangement described above may have the additional advantage of providing a means for axially aligning the installation parts during connection.

The first and second installation parts may be arranged to protect the region where electrical contact is made from the external environment in a number of ways. For example, the contact portion of one of the connector parts could be housed within a body of insulating plastics. In a preferred embodiment however, at least one of the installation parts contains electrically insulating fluid media. In the arrangement in which one of the installation parts has an annular projection and the other installation part has an annular socket, this annular socket preferably contains such media. Escape of the media can generally be prevented by the resilient seal or shuttle mentioned above. Thus appropriate sealing means is provided through which the annular projection extends in the connected state of the well installation.

In order to further improve the insulating characteristics of the well installation, at least one of the installation parts may comprise a plurality of chambers containing electrically insulating fluid media. In the case of the embodiment having an annular projection engageable in an annular socket, each chamber may have a respective sealing means through which the annular projection extends in the connected state of the well installation. Where a shuttle is provided, this extends through each sealing means when the installation parts are disconnected. There is preferably a primary chamber provided with primary sealing means and a secondary chamber provided with secondary sealing means, the annular projection extending through said primary and secondary sealing means in the connected state of the well installation. In view of its secondary function, the secondary sealing means may not make a fluid-tight seal with the annular projection (or with the shuttle, if provided), but it preferably does so.

In the embodiment where a conductive shuttle provides the contact portion of one of the installation parts, when the installation parts are fully connected the electrical contact between the shuttle and the contact portion of the other connector part preferably takes place in the secondary chamber. Electrical contact between the shuttle and the contact terminal of its respective installation part also preferably takes place in the secondary chamber.

It is preferable to balance the pressure within the (or each) installation part containing electrically insulating fluid media relative to the external pressure to minimise any tendency for entry of contaminants of water, i.e. to improve the sealing. Preferably therefore, such installation part has a flexible wall portion. In the arrangement where the installation has an annular projection engageable in an annular socket, the annular socket preferably has a flexible wall portion. In a preferred arrangement, the annular socket is provided in a housing and an opening is provided in the housing so as to expose the outside of the flexible wall portion to external pressure. This enables balancing of the pressure within the annular socket relative to external pressure, thereby reducing any tendency for entry of water or contaminants to the socket. Preferably, where the annular socket comprises plural chambers, they are each provided with respective flexible wall portions, preferably radially spaced from each other.

A preferred embodiment comprises an annularly extending primary chamber and an annularly extending secondary chamber radially adjacent to the primary chamber, wherein electrical contact is made in the secondary chamber. The chambers preferably contain electrically insulating fluid media. The annularly extending primary chamber may have a flexible wall portion the outside of which is exposed in use to ambient pressure, and the annularly extending secondary chamber may have a flexible wall portion the outside of which is exposed to the media in the primary chamber. This gives good protection to the region inside the secondary chamber whilst allowing for volume expansion of the secondary chamber during connection, and for pressure balancing of both the primary and secondary chambers.

The annularly extending primary and secondary chambers may share a common opening, but preferably the primary chamber has a primary opening and the secondary chamber has a secondary opening disposed longitudinally inwardly of the primary opening. Thus, when the e.g. annular projection passes through the openings during connection, it may be wiped at each opening by e.g. primary and secondary sealing means. It is preferred for the secondary opening to be longitudinally inwardly spaced from the primary opening. The e.g. annular projection may then be bathed in electrically insulating fluid media as it passes from the primary opening to the secondary opening during connection. In general the openings will be closed, for example by the resilient seal or shuttle mentioned, when the installation parts are disconnected.

The well installation may provide a so-called one way connector, i.e., one electrical connection is made when the installation parts are mated. An electrical circuit may then be completed via dedicated contacts. It is however possible to provide plural or multiple way connectors. An example of a two-way connector is described above in relation to the embodiment having contact segments. In another example, a first set of electrical contact portions may be arranged to establish electrical contact at a first lateral spacing from the aligned longitudinal axes, and a second set of electrical contact portions may be arranged to establish electrical contact at a second lateral spacing from the longitudinal axes. This can provide a two way connector. Further such sets may be provided at further lateral spacings, to provide three, four etc way connectors.

Alternatively, a first set of electrical contact portions could be arranged to establish electrical contact at a first position along the aligned longitudinal axes and laterally spaced therefrom, and a second set of electrical contact portions could be arranged to establish electrical contact at the same lateral spacing from the longitudinal axes and longitudinally spaced from the first set of electrical contact portions, thus providing a two way connector. Further sets of contact portions could be provided at further longitudinal spacings, to provide three or more way connectors. This arrangement is particularly suitable for embodiments having an annular shuttle made of an insulating material.

When electrical contact portions arranged at a lateral spacing from a longitudinal axis, as described above, are used to make an electrical connection between two parts of an underwater or severe environment installation, such as e.g. a subsea tree, the need accurately to rotationally align those parts can be avoided, thereby simplifying the assembly of such installations.

It will be appreciated that although the problem which the invention seeks to solve has been described in relation to subsea tree systems, there are aspects of the invention which could be used in other systems where a similar problem is found and so those aspects of the invention are not limited to such subsea tree systems and are applicable more generally to electrical connectors.

Viewed from another aspect, the invention provides an underwater or severe environment electrical connector, comprising first and second connector parts which are to be brought together in longitudinal alignment to establish electrical contact between respective contact portions of the first and second connector parts, the connector parts being relatively rotatable about a longitudinal axis when the connector parts are disconnected, and the contact portions being laterally spaced from said longitudinal axis and being arranged to make said electrical contact when the connector parts are connected, such electrical contact being achievable at a plurality of different relative rotational positions of the first and second connector parts about said longitudinal axis, wherein one of the connector parts comprises an axial projection on which a respective contact portion is provided, and the other connector part comprises an annular socket in which the axial projection is engageable.

An effective electrical connection can be made by the use of an annular socket, whilst requiring no or only coarse rotational alignment, and providing a lateral space can allow room for other components, equipment etc.

The contact portions are preferably at a substantial lateral spacing from the longitudinal axis. The lateral spacing is preferably substantially larger, e.g. several times larger than, the size of the faces of the contact portions which make contact with each other. For example, such contacting faces of the contact portions may extend laterally or longitudinally, or at an intermediate angle between purely lateral or longitudinal, to define a "contact face width". The lateral spacing is preferably substantially larger than the contact face width, more preferably five or ten times larger.

In preferred embodiments, no electrical contact portions are provided along the longitudinal axis. The only contact portions are laterally spaced from the axis. Preferably, no electrical contact is made on or near the longitudinal axis.

Viewed from a further aspect the invention provides an underwater or severe environment electrical connector, comprising first and second connector parts which are to be brought together in longitudinal alignment to establish electrical contact between respective contact portions of the first and second connector parts, the connector parts being relatively rotatable about a longitudinal axis when the connector parts are disconnected, and the contact portions being laterally spaced from said longitudinal axis and being arranged to make said electrical contact when the connector parts are connected, such electrical contact being achievable at a plurality of different relative rotational positions of the first and second connector parts about said longitudinal axis.

The electrical connectors disclosed herein may be useful in various systems, including vertical subsea tree systems as discussed. They may however also be useful in the case of a horizontal subsea tree, since although the production line exits the tubing hanger horizontally, it may be convenient to leave the central region above where the production line branches off horizontally free of electrical connection components.

The various preferred and optional features discussed above in relation to a well installation are of course also features which may optionally be applied to an electrical connector of the invention.

BRIEF DESCRIPTION OF THE DRAWINGS

A preferred embodiment of the invention will now be described, by way of example only, and with reference to the accompanying drawings in which.

DETAILED DESCRIPTION OF THE PREFERRED EMBODIMENTS

Figure 1:
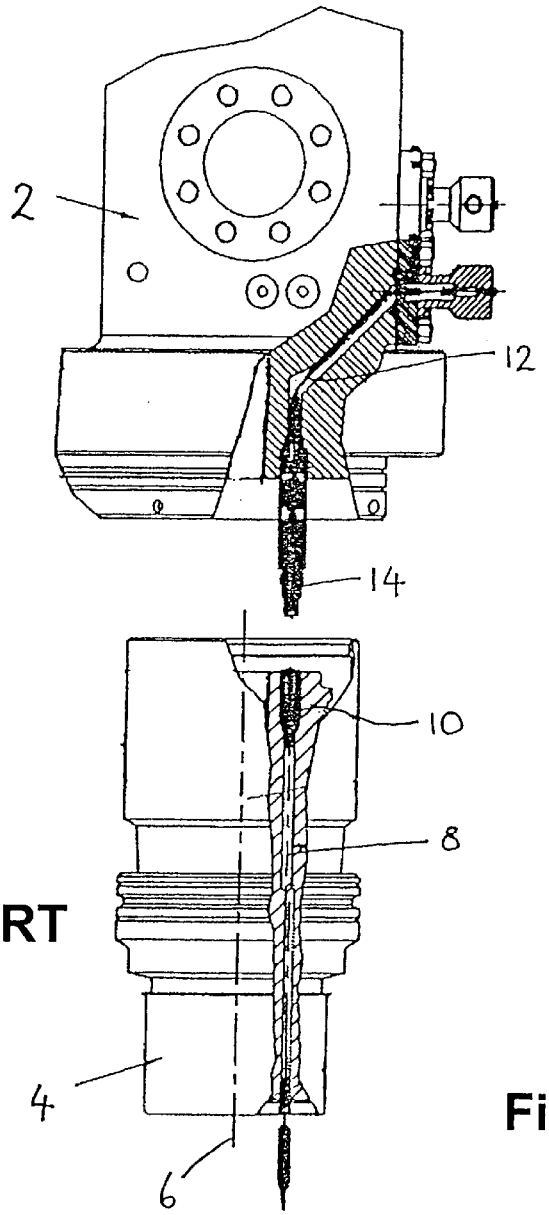
PRIOR ART Figure 1
FIG. 1 is a vertical partly sectional view of a subsea installation known in the art.
Figure 2:
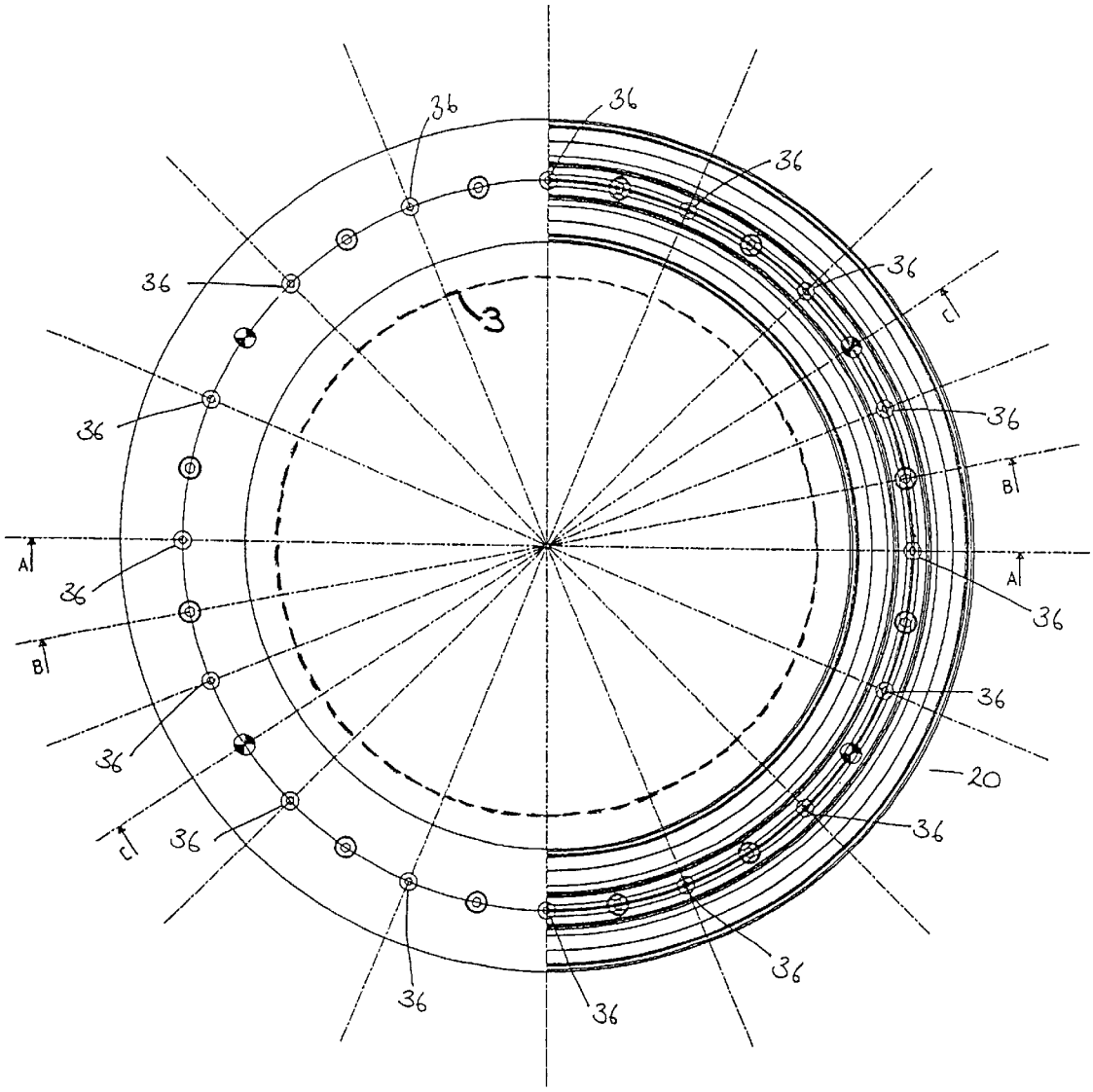
FIG. 2 is a plan view of a connector according to the invention.
Figure 3:
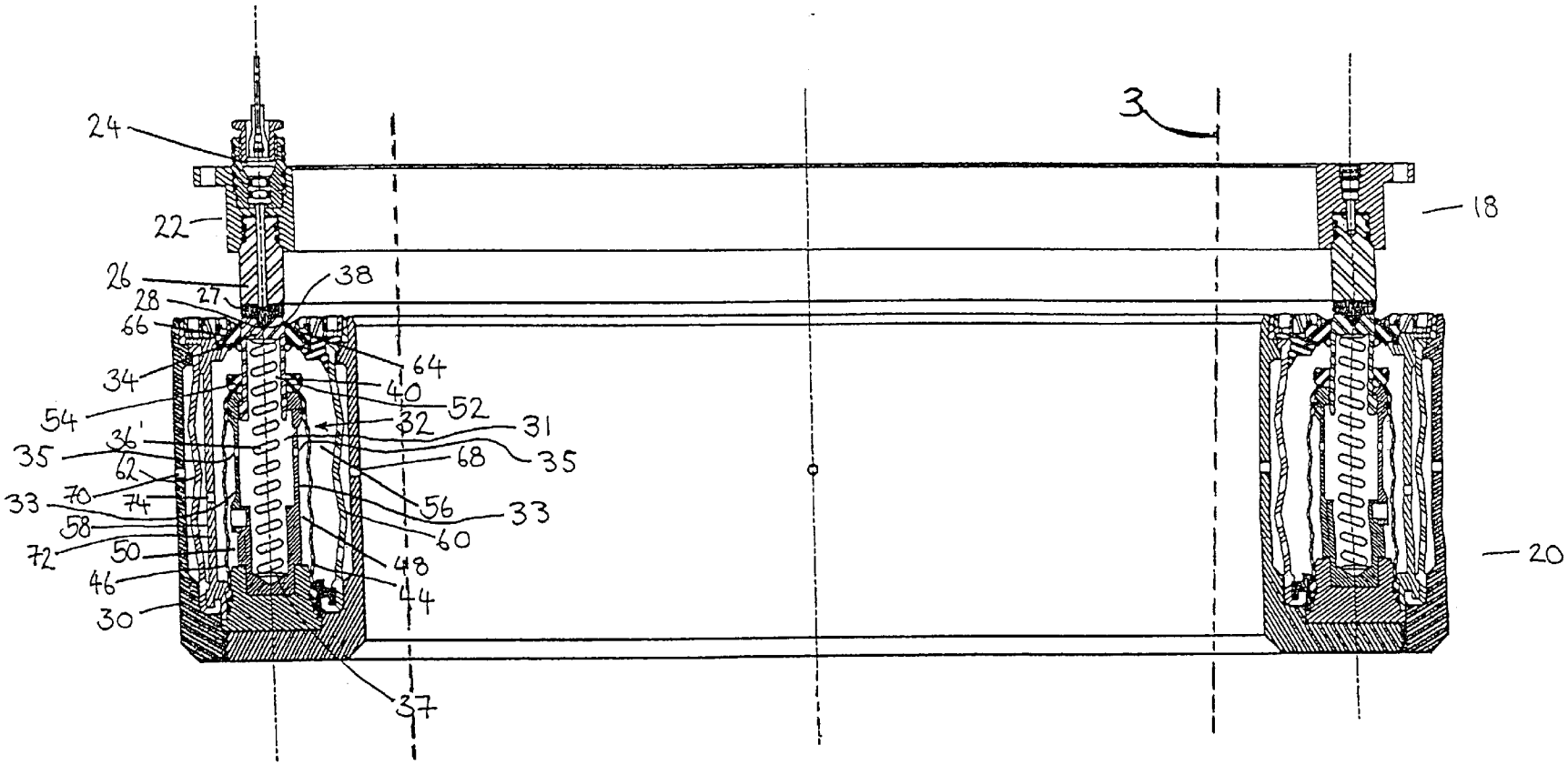
FIG. 3 is a section along line A—A of FIG. 2.

A typical vertical feedthrough system as used in the oil and gas industry is shown in FIG. 1. As can be seen, the system includes a valve block 2 for attachment to a vertical tubing hanger 4. A central bore (not shown) for transporting oil is provided on the longitudinal axis 6 of the tubing hanger.

An electrical supply line 8 extends through the tubing hanger 4 and is arranged to extend parallel to and at a distance from the longitudinal axis 6. As shown, a receptacle connector part 10 is provided at the end of the supply line 8.

A second electrical supply line 12 extends through the valve block 2. At the end of the valve block for connection to the tubing hanger, the electrical supply line is again arranged to extend parallel to and at a distance from the longitudinal axis (not shown) of the valve block. Further, the distance of each electrical supply line from the respective longitudinal axes is the same. A plug connector part 14 is provided at the end of the valve block supply line and, when the valve block and tubing hanger are connected in use, they are axially and rotationally aligned so that the plug connector part 14 is received in the receptacle connector part 10 and an electrical connection is formed between the valve block electrical supply line 12 and the tubing hanger electrical supply line 8.

As described above, the traditional plug and receptacle connection means as shown in FIG. 1 complicates the connection of the valve block to the tubing hanger as the tubing hanger and valve block must be very accurately rotationally aligned before the plug connector part can mate with the receptacle connector part to form an electrical connection. This results in the installation procedure being relatively time consuming and difficult.

The connector of the embodiment of the invention is shown in FIGS. 2 to 5. As can be seen, the connector comprises an annular first connector part 18 for attachment to the valve block 2 and an annular second connector part 20 for attachment to the tubing hanger 4. A well production line 3 extends along the connector parts' aligned longitudinal axes when they are connected with each other.

The first connector part 18 comprises an annular housing 22 made of electrically insulating material such as PEEK (trademark). Electrical feedthrough means 24 connect the electrical supply line of the valve block to an annular projection 26 having at its lower end an annular contact ring 27 made of electrically conductive material and arranged below the housing 22. The contact ring 27 may be made of gold plated copper. A projection 28 which is triangular in cross section extends around the base of the annular contact ring to facilitate axial alignment between the contact ring 27 and the second connector part 20 as will become apparent below.

The second connector part 20 comprises an annular housing 30 in which an annular socket 32 is formed. Inside the annular socket, there is defined an annular region 31, located between rigid annular walls 33. At the upper end of the socket 32 an opening is closed by an annular shuttle ring 34. This is resiliently biased towards the opening of the socket in its position of rest to seal the socket from the external environment. The resilient bias on the annular shuttle ring 34 is provided by a plurality of compression springs 36 extending between the base 37 of the socket and the annular shuttle ring and arranged at regular intervals around the circumference of the annular socket.

The annular shuttle ring 34 is made of electrically conductive material such as gold plated copper. It has a triangular recess 38 provided in the top surface thereof, the shape of which corresponds to the triangular projection 28 on the annular contact ring 27 of the first connector part 18. A cylindrical recess 40 is formed extending upwardly from the base of the annular shuttle ring and the purpose of this recess will become apparent below.

Figure 4:
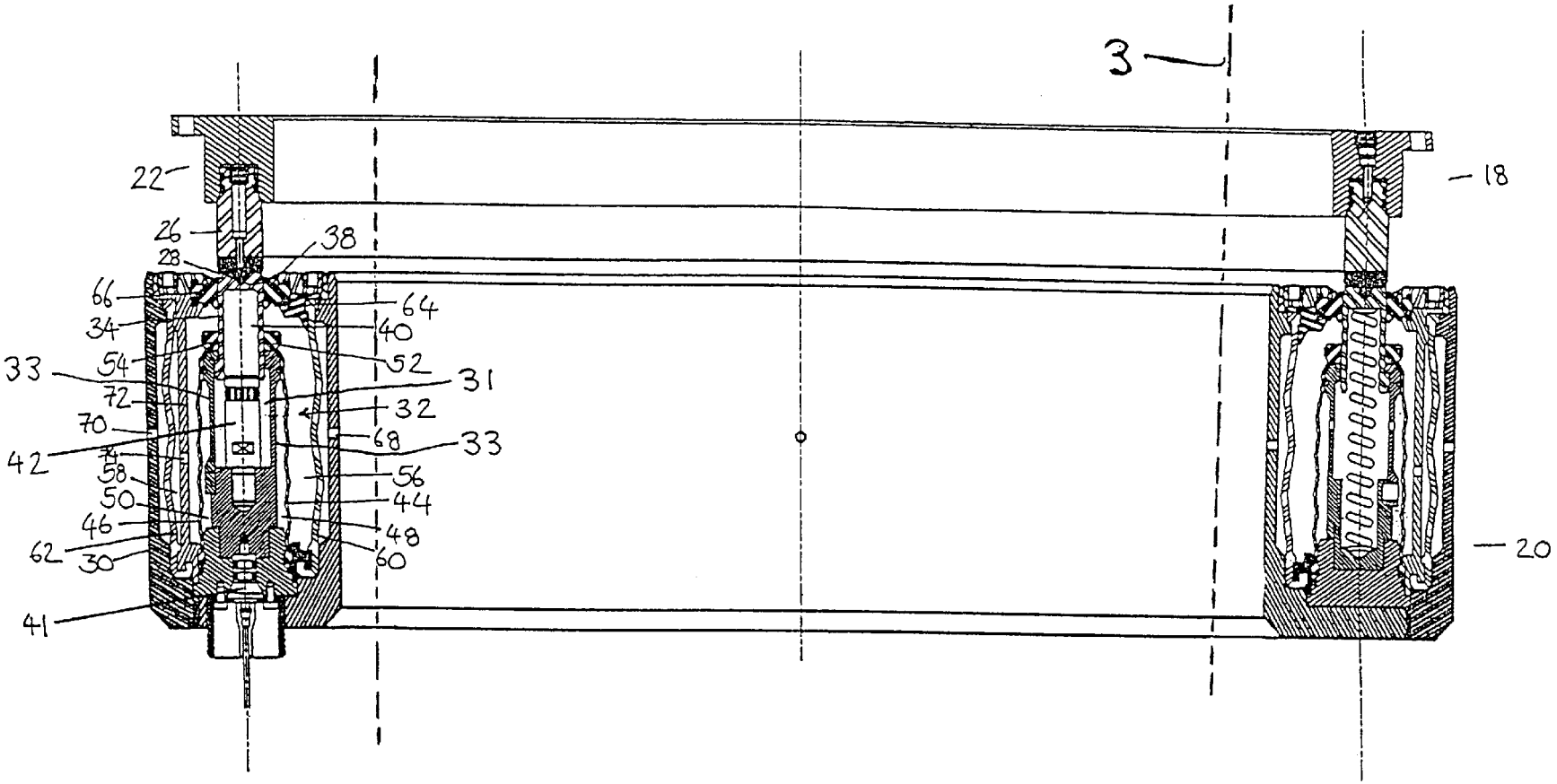
FIG. 4 is a section along line C-A of FIG. 2.
Figure 5:
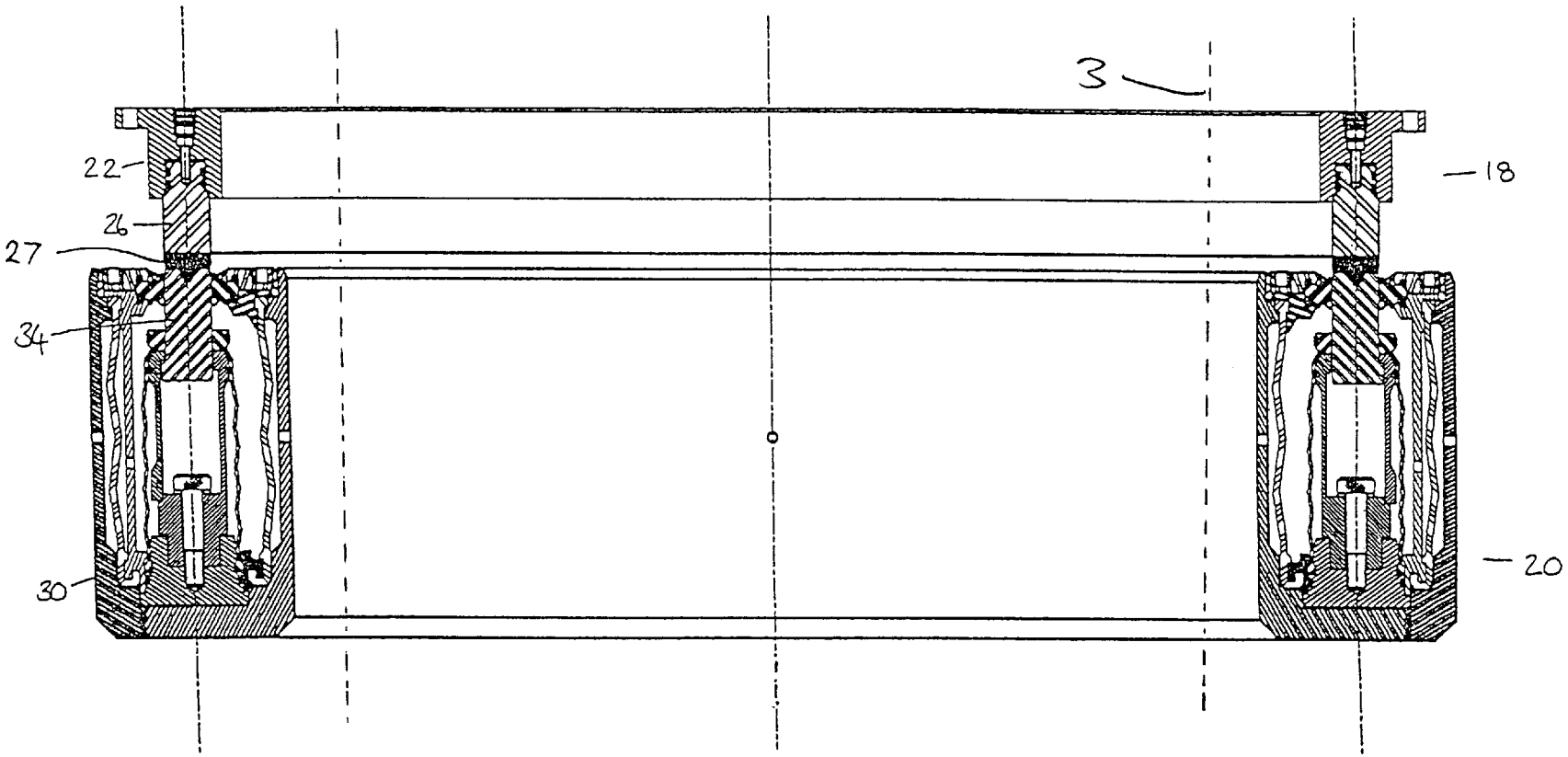
FIG. 5 is a section along line B—B of FIG. 2.

As shown in FIG. 4, the second connector part 20 also comprises electrical feedthrough means 41 for connection to the electrical supply line 8 in the tubing hanger 4. A terminal in the form of a contact pin 42 made of electrically conductive material is provided within the annular socket 32 of the second connector part 20. This contact pin is shaped so as to fit snugly with the recess 40 in the annular shuttle ring 34 when the first and second connector parts are moved into engagement with one another. Thus an electrical connection will be formed between the annular shuttle ring 34 and the contact pin 42 which in turn is in electrical contact with the electrical feedthrough means 41. The contact pin 42 also guides the axial alignment of the first 18 and second 20 connector parts during connection due to the snug fit of the contact pin 42 within the recess 40 in the annular shuttle ring 34.

In order to electrically insulate the interior of the second 20 connector part means from the external environment, primary inner and outer annular chambers 56, 58 and secondary inner and outer chambers 48, 50 are provided. Annular flexible membrane walls 44, 46 are provided inside the housing 30 and are arranged radially spaced from each other inside and outside the annular region 31 into which the annular shuttle ring 34 is to be pushed back, respectively. Thus the secondary inner 48 and outer 50 chambers are formed between the flexible membrane walls 44, 46 and the walls 33 of the annular region 31. The walls are provided with openings 35 to communicate the secondary inner and outer chambers 48, 50 and the annular region 31. The top of the secondary chambers are sealed with first and second annular seal members 52, 54 respectively, the seal members being in contact with the annular shuttle ring 34 when the annular shuttle ring is in its uppermost (closing) position, as shown.

The primary inner and outer annular chambers 56, 58 are formed between the first annular flexible membrane walls 44, 46 and further annular flexible membrane walls 60, 62 which are provided radially inwardly and outwardly of the flexible walls 44, 46, respectively. These primary chambers 56, 58 are sealed by annular seal members 64, 66. The annular seal members 64, 66 are arranged to contact the annular shuttle ring 34 when the shuttle ring is in its uppermost (closing) position, as shown.

Each of the four annular chambers formed by the flexible membrane walls and the annular region 31 is filled with insulating dielectric fluid media such as oil, grease or the like. Further, openings 68, 70 are provided in the radially inner and outer housing walls so that the primary inner and outer flexible membrane walls 60, 62 are vented to outside pressure. Thus, when the connector is submerged and is subject to increasing pressures, the membranes deflect inwardly to decrease the volume of the primary chambers and so balance the pressure therein with the increased external pressure. In this way, any tendency for water from the outside to enter the primary chambers is reduced.

A further non-flexible wall 72 having an opening 74 therein is also provided within the primary outer chamber 58. Thus, flexible membrane wall 62 is confined between, and protected by, the outer housing wall and the wall 72.

The provision of openings 35 in the inner and outer walls 33 of the annular region 31 allows dielectric fluid to flow between the secondary inner and outer annular chambers and the annular region 31 as required. Thus, the secondary inner and outer chambers may expand and contract depending upon the pressure to which they are exposed. Via their flexible membrane walls they are respectively exposed to the pressure in the primary inner and outer chambers. Further, when the annular shuttle piston 34 is pushed down into the annular socket 32, dielectric fluid from within the socket will flow out of the annular region 31 through the openings 35 into the secondary annular chambers 48, 50.

In use, the connector described is used as follows. The first connector part 18 is connected to the valve block 2 such that the electrical supply line from the valve block is connected to the electrical feedthrough means 24. The second connector part 20 is connected to the tubing hanger 4 such that the tubing hanger electrical supply line 8 is connected with the electrical feedthrough 40.

The parts are then ready for connection and the tubing hanger and valve block are brought into approximate axial alignment and are then moved together until the triangular projection 28 on the annular contact ring 26 fits within the triangular recess 38 in the annular shuttle ring 34. At this point, the first and second connector parts 18, 20 are precisely axially aligned. Then, as the valve block and tubing hanger continue to be pushed together, the annular contact ring 27 pushes the shuttle ring 34 back into the annular socket 32 within the housing 30 of the second connector part 20.

When the first and second connector parts 18, 20 and the tubing hanger 4 and valve block 2 are fully connected, a contact band of the contact pin 42 rests against the side surface of the recess 40 in the shuttle ring 34. Thus, electrical contact is achieved between the first and second electrical supply lines without the need for rotationally aligning the valve block and tubing hanger prior to connection.

Although the invention has been described with reference to one preferred embodiment, it will be appreciated that this description is not intended to be limiting to the scope of the invention. For example, the annular projection could be provided on the tubing hanger and the annular socket on the valve block. This would have the advantage that the simplest part, which is potentially the most reliable, would be fitted to the least retrievable part of the system. A connector embodying all the features of the invention could be used to form electrical connections in systems other than subsea vertical feedthrough systems. Similarly, alternative means for sealing the interior of the connector from the external environment could be used, such as for example rubber seals.

What is claimed is:

1. An underwater or severe environment well installation, comprising first and second installation parts having respective longitudinal axes and being connectible with each other with their longitudinal axes in alignment, a first electrical contact portion on the first installation part, and a second electrical contact portion on the second installation part, the contact portions being laterally spaced from the respective longitudinal axes of the installation parts and being arranged to make electrical contact with each other when the first and second installation parts are connected, such electrical contact being achievable at a plurality of different relative rotational positions of the first and second installation parts about their longitudinal axes, and the first and second installation parts further comprising a well production line extending along their aligned longitudinal axes when they are connected with each other, wherein one of the installation parts comprises an axial projection on which a respective electrical contact portion is provided, and wherein the other installation part comprises an annular socket in which the annular projection is engageable and an annular shuttle resiliently mounted to close the annular socket in the disconnected state of the well installation and arranged to be pushed back into the annular socket by the axial projection when the first and second installation parts are brought together.

2. A well installation as claimed in claim 1, wherein the annular shuttle comprises electrically conductive material and itself provides the electrical contact portion of the respective installation part.

3. A well installation as claimed in claim 2, comprising a contact terminal in the annular socket with which the annular shuttle is not in electrical contact when the installation parts are disconnected, the contact terminal being arranged to be electrically contacted by the annular shuttle when it is pushed back during connection.

4. A well installation as claimed in claim 3, wherein the contact terminal comprises at least one contact pin extending longitudinally in the annular socket and arranged to contact the annular shuttle.

5. A well installation as claimed in claim 4, wherein the annular shuttle comprises a recess corresponding in radial cross section to the shape of the contact pin such that the contact pin contacts the side wall of the recess when the shuttle is pushed onto the contact pin.

6. A well installation as claimed in claim 1, wherein the first installation part is a valve block and the second installation part is a tubing hanger.

7. An underwater or severe environment well installation, comprising first and second installation parts having respective longitudinal axes and being connectible with each other with their longitudinal axes in alignment, a first electrical contact portion on the first installation part, and a second electrical contact portion on the second installation part, the contact portions being laterally spaced from the respective longitudinal axes of the installation parts and being arranged to make electrical contact with each other when the first and second installation parts are connected, such electrical contact being achievable at a plurality of different relative rotational positions of the first and second installation parts about their longitudinal axes, and the first and second installation parts further comprising a well production line extending along their aligned longitudinal axes when they are connected with each other, wherein at least one of the installation parts contains electrically insulating fluid media.

8. A well installation as claimed in claim 7, wherein at least one of the installation parts comprises an annular member for engagement with the other installation part.

9. A well installation as claimed in claim 7, wherein said at least one installation part comprises a plurality of chambers containing electrically insulating fluid media.

10. A well installation as claimed in claim 7, wherein said at least one installation part comprises a flexible wall portion.

11. An underwater or severe environment well installation, comprising first and second installation parts having respective longitudinal axes and being connectible with each other with their longitudinal axes in alignment, a first electrical contact portion on the first installation part, and a second electrical contact portion on the second installation part, the contact portions being laterally spaced from the respective longitudinal axes of the installation parts and being arranged to make electrical contact with each other when the first and second installation parts are connected, such electrical contact being achievable at a plurality of different relative rotational positions of the first and second installation parts about their longitudinal axes, and the first and second installation parts further comprising a well production line extending along their aligned longitudinal axes when they are connected with each other, wherein one of the installation parts comprises an annularly extending primary chamber and an annularly extending secondary chamber radially adjacent to the primary chamber, wherein electrical contact is made in the secondary chamber.

12. An underwater or severe environment electrical connector, comprising first and second connector parts which are to be brought together in longitudinal alignment to establish electrical contact between respective contact portions of the first and second connector parts, the connector parts being relatively rotatable about a longitudinal axis when the connector parts are disconnected, and the contact portions being laterally spaced from said longitudinal axis and being arranged to make said electrical contact when the connector parts are connected, such electrical contact being achievable at a plurality of different relative rotational positions of the first and second connector parts about said longitudinal axis, wherein one of the connector parts comprises an axial projection on which a respective contact portion is provided, and the other connector part comprises an annular socket in which the axial projection is engageable and an annular shuttle resiliently mounted to close the annular socket in the disconnected state of the connector and arranged to be pushed back into the annular socket by the axial projection when the first and second connector parts are brought together.

13. A connector as claimed in claim 12, wherein the annular shuttle comprises electrically conductive material and itself provides the contact portion of the respective connector part.

14. A connector as claimed in claim 13, comprising a contact terminal in the annular socket with which the annular shuttle is not in electrical contact when the connector parts are disconnected, the contact terminal being arranged to be electrically contacted by the annular shuttle when it is pushed back during connection.

15. A connector as claimed in claim 14, wherein the contact terminal comprises at least one contact pin extending longitudinally in the annular socket and arranged to contact the annular shuttle.

16. A connector as claimed in claim 15, wherein the annular shuttle comprises a recess corresponding in radial cross section to the shape of the contact pin such that the contact pin contacts the side wall of the recess when the shuttle is pushed onto the contact pin.

17. An underwater or severe environment electrical connector, comprising first and second connector parts which are to be brought together in longitudinal alignment to establish electrical contact between respective contact portions of the first and second connector parts, the connector parts being relatively rotatable about a longitudinal axis when the connector parts are disconnected, and the contact portions being laterally spaced from said longitudinal axis and being arranged to make said electrical contact when the connector parts are connected, such electrical contact being achievable at a plurality of different relative rotational positions of the first and second connector parts about said longitudinal axis, wherein one of the connector parts comprises an axial projection on which a respective contact portion is provided, and the other connector part comprises an annular socket in which the axial projection is engageable, and wherein at least one of the connector parts contains electrically insulating fluid media.

18. A connector as claimed in claim 17, wherein said at least one connector part comprises a plurality of chambers containing electrically insulating fluid media.

19. A connector as claimed in claim 17, wherein said at least one connector part comprises a flexible wall portion.

20. An underwater or severe environment electrical connector, comprising first and second connector parts which are to be brought together in longitudinal alignment to establish electrical contact between respective contact portions of the first and second connector parts, the connector parts being relatively rotatable about a longitudinal axis when the connector parts are disconnected, and the contact portions being laterally spaced from said longitudinal axis and being arranged to make said electrical contact when the connector parts are connected, such electrical contact being achievable at a plurality of different relative rotational positions of the first and second connector parts about said longitudinal axis, wherein one of the connector parts comprises an axial projection on which a respective contact portion is provided, and the other connector part comprises an annular socket in which the axial projection is engageable, and wherein said other connector part comprises an annularly extending primary chamber and an annularly extending secondary chamber radially adjacent to the primary chamber, wherein electrical contact is made in the secondary chamber.

* * * * *